US005554000A

United States Patent [19]

Katoh et al.

[11] Patent Number: 5,554,000

[45] Date of Patent: Sep. 10, 1996

[54] BLADE PROFILE FOR AXIAL FLOW COMPRESSOR

[75] Inventors: Yasuhiro Katoh, Hitachi; Yoshihiro Tsuda, Katsuta; Mitsuaki Yanagida, Hitachi; Hajime Toriya, Hitachi; Tetsuo Sasada, Hitachi, all of Japan

[73] Assignee: Hitachi, Ltd., Tokyo, Japan

[21] Appl. No.: 302,261

[22] Filed: Sep. 8, 1994

[30] Foreign Application Priority Data

Sep. 20, 1993 [JP] Japan ..... 5-232776

[51] Int. Cl.[6] ..... F01D 9/04

[52] U.S. Cl. ..... 415/208.200; 415/181; 415/191; 415/193; 415/211.2; 416/223 A; 416/243; 416/DIG. 2

[58] Field of Search ..... 415/181, 191–193, 415/208.1, 208.2, 211.2, 914; 416/223 A, 228, 235, 243, DIG. 2

[56] References Cited

U.S. PATENT DOCUMENTS

| | | | |
|---|---|---|---|
| 2,953,295 | 9/1960 | Stalker | 415/191 |
| 3,333,817 | 8/1967 | Rhomberg | 415/181 |
| 4,408,957 | 10/1983 | Kurzrock et al. | 416/223 A |

OTHER PUBLICATIONS

"Reduction of End–Wall Effects in a Small, Low–Aspect–Ratio Turbine By Radial Work Redistribution", by J. C. Schlegel et al., Transactions of the ASME, Jan., 1976, pp. 130–137.

"NASA, SP–36 (Aerodynamic Design Of Axial–Flow Compressors)", 1965, pp. 151–254.

Japan Society Of Mechanical Engineers, 343rd Conference (1971), "Pumps and Blowers: Theories and Applications", pp. 37–52.

Y. Kashiwabara et al, "Developments Leading to an Axial Flow Compressor for a 25 MW Class High Efficiency Gas Turbine", pp. 1–9, published by The American Society of Mechanical Engineers (presented at the Gas Turbine and Aeroengine Congress and Exposition, Jun. 11–14, 1990, Brussels, Belgium).

*Primary Examiner*—Edward K. Look
*Assistant Examiner*—Christopher Verdier
*Attorney, Agent, or Firm*—Fay, Sharpe, Beall, Fagan, Minnich & McKee

[57] ABSTRACT

An axial flow compressor for use in a gas turbine or other industrial application having an improved efficiency is provided through modification of the blade shape and profile of the blades subject to a subsonic high velocity inlet flow so as to avoid shock losses in the blade rows, and improve the total efficiency. The curvature distribution on the suction surface of the stator blade rows or rotor blade rows of the axial flow compressor is adapted to have a local minimum in a region toward the leading edge of the blade, and then a local maximum. Thereby, an excessive increment in velocity on the suction surface from the leading edge to the position of the maximum velocity can be suppressed, and the occurrence of a shock wave can be avoided so as to minimize pressure loss in the blade rows, thus increasing the total efficiency of the axial compressor.

12 Claims, 8 Drawing Sheets

BLADE PROFILE FOR AXIAL FLOW COMPRESSOR

BACKGROUND OF THE INVENTION

The present invention relates to axial flow compressors for use in gas turbines or industrial applications, and in particular, it relates to axial flow compressors having axial compressor blades that exhibit high performance and low pressure loss.

Conventional axial flow compressors have heretofore employed NACA-65 profiles which have been developed for use in subsonic applications as has been described in the document "NASA, SP-36 (AERODYNAMIC DESIGN OF AXIAL-FLOW COMPRESSORS )"1965. In recent years, however, demands for higher pressure rate and improved efficiency are necessitating various attempts to increase the velocity at the inlet of the blade rows.

Regarding transonic blade rows, a double circular arc profile in which the suction surface and pressure surface are composed of single circular arcs, respectively, is described in the literature "Pumps and Blowers: Theories and Applications", 343rd Conference (1971), Japan Society of Mechanical Engineers.

The conventional axial compressors have a problem in that pressure loss due to shock waves occurring on the blade surface becomes excessively great when the inlet Mach number exceeds the critical Mach number, thereby lowering efficiency substantially. Further, blade profile losses tend to increase as a result of the shock wave arising with an increase in the velocity at the inlet of the blade rows.

Therefore, it is important to provide for blade profiles which exhibit high performance, in particularly, when the inlet flow is in a higher subsonic region and in a transonic range.

SUMMARY OF THE INVENTION

The present invention has been contemplated to solve the aforementioned problems associated with the prior art. The main purpose of the invention is to avoid or weaken the occurrence of the shock waves through improvements in the blade profile subject to the inlet flow in the vicinity of the sonic velocity including, for example, a higher subsonic and a transonic range, to eliminate or decrease pressure loss due to the shock waves so as to provide a high efficiency axial compressor.

An axial flow compressor according to one aspect of the present invention comprises a plurality of stator blade rows arranged on the inner surface of a casing and a plurality of rotor blade rows arranged on the rotor, the inner surface of the casing and the rotor constituting an annular passage therebetween. The present invention is characterized according to this aspect in that a curvature distribution on the suction surface of each of these stator blade rows and/or the rotor blade rows is changed.

The change in this curvature distribution on the suction surface is arranged to have a local minimum to be followed by a local maximum in the direction from its leading edge to its trailing edge.

Further, an axial flow compressor according to another aspect of the invention having a plurality of stator blade rows arranged on the inner surface of a casing and a plurality of rotor blade rows arranged on the rotor, with the inner surface of the casing and the rotor constituting an annular passage therebetween, is characterized in that a curvature distribution on the suction surface of each of the stator blade rows and/or the rotor blade rows has a local minimum on the blade surface between a position where the Mach number becomes 1 and a position where a maximum velocity is indicated.

Still further, an axial flow compressor according to still another aspect of the invention having a plurality of stator blade rows arranged on the inner surface of a casing and a plurality of rotor blade rows arranged on the rotor, with the inner surface of the casing and the rotor constituting an annular passage therebetween, is characterized in that a curvature distribution on the suction surface of each of the stator blade rows and/or the rotor blade rows is arranged to have a local minimum in a region which corresponds to a region on the suction surface where a maximum velocity is indicated.

Furthermore, an axial flow compressor according to yet another aspect of the invention having a plurality of stator blade rows arranged on the inner surface of a casing which constitutes an annular passage and a plurality of rotor blade rows arranged on a rotor is characterized in that each of the suction surface or pressure surface of at least one row of the blades comprises at least two circular arcs the joint points of which lie toward a trailing edge both from the center of a blade chord length and a suction surface throat position, and in that a first circular arc of said at least two circular arcs which is toward a leading edge of the blade is adapted to have a larger radius of curvature than that of a second circular arc which is toward a trailing edge thereof.

Further, it is preferable for the axial compressor according to the invention to have such an arrangement that said joint line connecting the at least two circular arcs extending from a blade tip cross-section to a blade root cross-section is adapted to gradually shift toward the leading edge.

Further, it is preferable for the axial compressor according to the invention to have such an arrangement that a blade profile at the blade root of said stator blade or said rotor blade where the inlet Mach number is low is adapted to have a double circular arc blade profile or an NACA-65 blade profile. Here, the double circular arc profile refers to one in which the suction surface and the pressure surface are composed of a single circular arc, and the NACA-65 blade profile refers to one which is determined by a camber line indicative of a camber of the blade and a blade thickness distribution.

Still further, an axial flow compressor according to another further aspect of the invention having a plurality of stator blade rows mounted on the inner surface of a casing which constitutes an annular passage and a plurality of rotor blade rows mounted on a rotor is characterized in that each of the suction surface and/or the pressure surface of at least a row of blades of the stator blade rows or the rotor blade rows comprises circular arcs having an extreme value the joint line therebetween lying toward the leading edge of the blade from both the center of the chord length and from the suction surface throat position.

Namely, the present invention accomplishes its objects by arranging the curvature distribution on the suction surface of the stator blade or rotor blade to have a local minimum, and subsequently a local maximum in a direction from the leading edge to the trailing edge of the blade.

That is, when the stator blade or rotor blade of any axial flow compressor is adapted to have the aforementioned blade profile, an occurrence of a shock wave can be avoided since a smooth deceleration from a supersonic region taking place on the suction surface can be attained. Therefore, pressure loss in the blade rows can be minimized, consequently improving the total efficiency of the axial flow compressor substantially.

Further, when each suction surface or pressure surface of at least one row of blades of the stator blade rows or rotor blade rows is adapted to comprise at least two circular arcs the joint line of which lies toward the trailing edge from the center of the chord length of the blade as well as from the suction surface throat position thereof, and when the radius of curvature for the first circular arc of said at least two circular arcs which is toward the leading edge is adapted to have a larger value than that of the radius of curvature for the second circular arc, a shock wave plane arising in the blade rows is caused to move toward the leading edge than from the throat position. As to the flow on the blade surface, since a rapid deceleration portion on the pressure surface is eliminated, and an acceleration rate of velocity on the leading edge portion is decreased, the maximum Mach number decreases. For the causes aforementioned, pressure loss in the blade rows can be lowered, thereby improving the total efficiency of the axial compressor.

BRIEF DESCRIPTION OF THE DRAWINGS

The invention will be more particularly described with reference to the accompanying drawings, in which.

PREFERRED EMBODIMENTS

Figure 1:
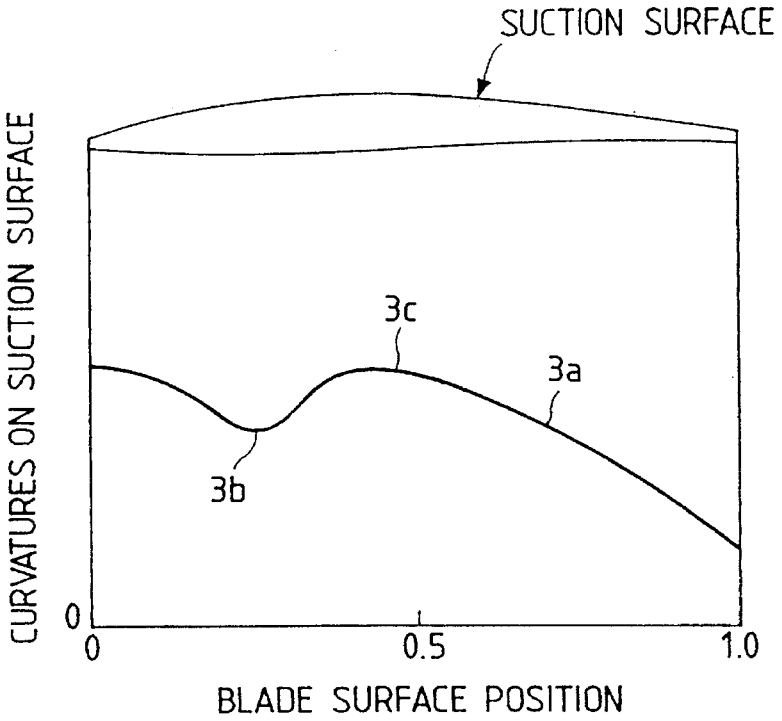
FIG. 1 shows a curvature distribution on the suction surface of a stator blade taken at a cross-section AA in FIG. 2.

A preferred embodiment of the invention will be described in detail with reference to FIGS. 1 and 2. FIG. 2 shows a cross-sectional view in part of a multi-stage axial flow compressor of an embodiment of the invention, and FIG. 1 shows the cross-section of the suction surface of the stator blade row taken along A—A in FIG. 2 and its curvature distribution with respect to the blade surface position.

In the multi-stage axial flow compressor as shown in FIG. 2, within an annular passage 2 which is composed of a casing 1 and a rotor 5 there are formed a row of stator blades 3 and a row of rotor blades 4, respectively. The stator blades 3 are fixed to the inner surface of the casing 1, while the rotor blades 4 are fixed to the rotor 5.

The rotor 5 is driven by a motor or turbine which is installed separately.

Figure 2:
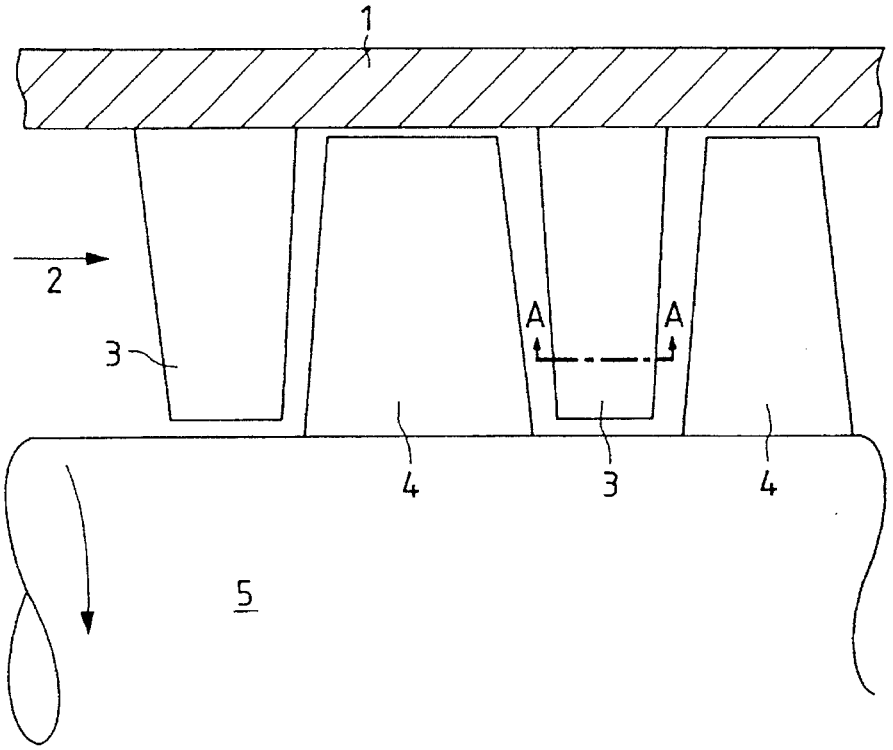
FIG. 2 is a cross-sectional view in part of a multi-stage compressor of an embodiment of the invention.

The curvature distribution from the leading edge to the trailing edge on the suction surface of the stator blade row 3 taken along the cross-section A—A in FIG. 2 is shown in FIG. 1, where a curve **3*a* indicative of the curvature distribution is adapted to have a local minimum 3*b* in a region toward the leading edge (blade surface position "0"), then a local maximum 3*c* toward the trailing edge(blade surface position "1.0"). Further, the local minimum 3*b* is located between a particular point where the Mach number on the blade surface becomes 1 and another point where a maximum velocity is indicated, and the local maximum 3*c*** is located in a region where the maximum velocity on the suction surface is indicated.

It is contemplated as advantageous for the positions of the local minimum **3*b* and the local maximum 3*c* to be formed in the first half portion (i.e., left of center in FIG. 1**) on the blade surface position, thereby preferably to provide for a curvature distribution as shown in the drawing.

To be more precise with the curvature distribution, it will show rapid changes according to the general blade structure in the vicinities of 0 and 1 on the abscissa of the blade surface position, however, no particular delineation will be made in detail in this respect in the drawing.

By providing for such a blade profile structure as above according to the invention, in a case where a fluid having a high subsonic velocity is allowed to hit the leading edge of the blade, it can be arranged such that while attaining a velocity exceeding the sonic on the suction surface, the velocity of the fluid to be ejected can be reduced to a subsonic velocity without the occurrence of a shock wave.

Figure 3:
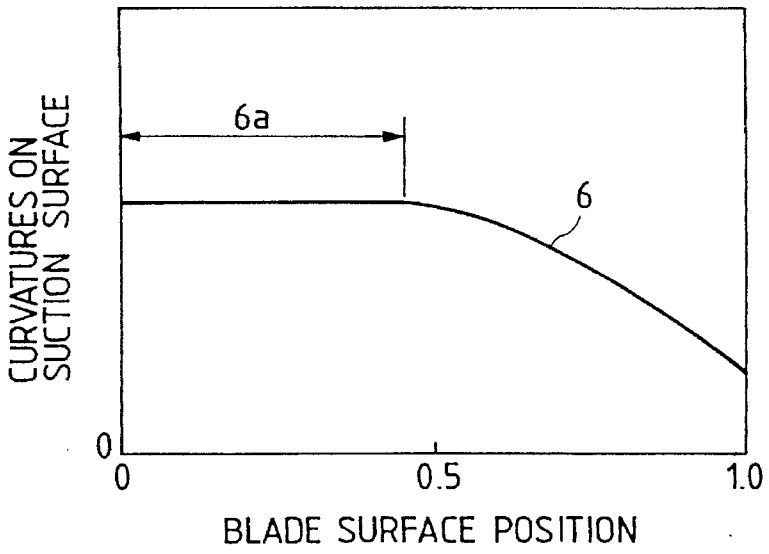
FIG. 3 is a curvature distribution on the suction surface of a conventional blade.
Figure 4:
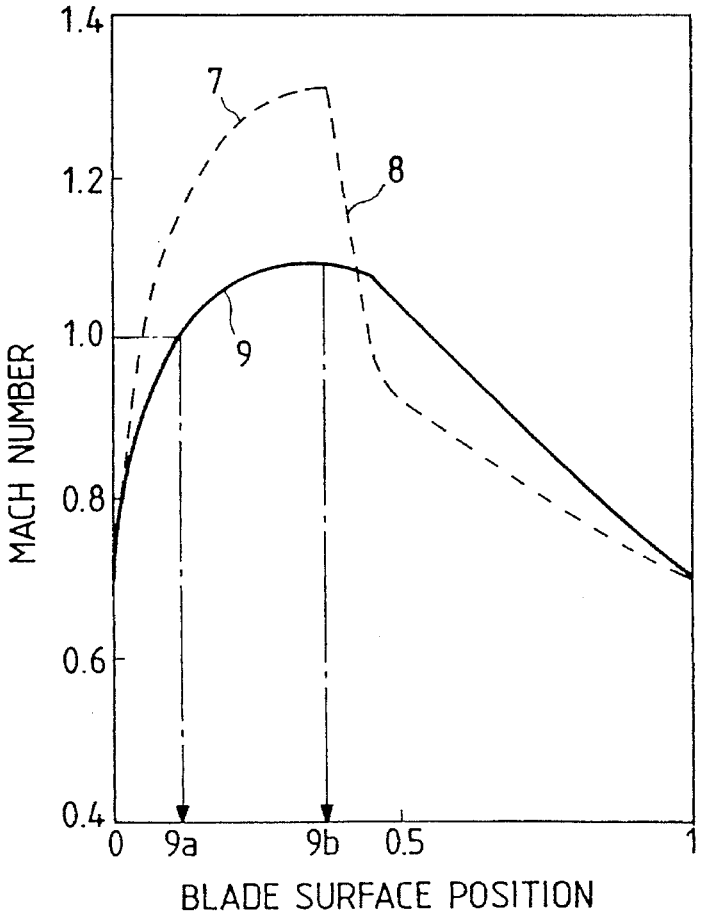
FIG. 4 illustrates distributions of Mach number on the suction surface.

With reference to FIGS. 3 and 4, acts of the blade structure having the profile according to the invention will be described in comparison with those of the conventional blade.

FIG. 3 shows a curvature distribution 6 on the suction surface of a conventional stator blade. FIG. 4 shows the results of measurements of Mach number distribution on the suction surface with respect to the blade surface position when the inlet Mach number was 0.8, which were obtained as an example of blade cascade tests conducted on the blade of the invention and that of the prior art.

With reference to FIG. 3, since a curvature distribution curve 6 on the suction surface has a constant curvature region **6*a* extending from the leading edge portion to the vicinity of the center portion of the blade as shown in the drawing, when its inlet flow becomes a higher subsonic velocity, there results in a rapid increment in velocity on the suction surface. As a result, the maximum Mach number of a blade surface velocity distribution curve 7 of the conventional blade rose approximately to 1.3, allowing a shock wave 8** to occur the downstream thereof. Thus due to pressure loss by the shock wave itself and an interaction with a boundary layer along the blade surface, the boundary layer would be separated adding up to pressure loss.

On the other hand, as described above, the curvature distribution 3*a* of the blade according to the invention is arranged to have the local minimum 3*b* once toward the leading edge, and then the local maximum 3*c* toward the trailing edge. Preferably, a local minimum region for the curvature, i.e., a region where the aforementioned local minimum 3*b* is to be formed, is between a position where the Mach number on the blade surface becomes 1, i.e., the position of 9*a* in FIG. 4, and a position in a local maximum region of the curvature where the aforementioned local maximum 3*c* is to be formed, i.e., the position 9*b* in FIG. 4 where the maximum velocity is to be indicated.

By way of example, the position of the local maximum 3*c* corresponds to the region on the suction surface where the maximum velocity is indicated.

As described above, the blade profile structure of the invention has such an effect to suppress an increment in the Mach number on the suction surface from 1 to a supersonic velocity. Further, the local maximum is ensured to satisfy required conditions necessary to attain a blade load which is determined by a design condition.

A Mach number distribution curve 9 shown in FIG. 4 represents the result of a cascade test with the blades according to the invention. It can be seen from the drawing that the Mach number distribution 9 of the blade according to the invention is 1.1 or less at maximum, and that a smooth decelerating flow from its supersonic region is obtainable without involving the occurrence of a shock wave. Namely, even if the inlet flow becomes a higher subsonic velocity, its incremental velocity on the suction surface can be suppressed from increasing rapidly as having been observed in the prior art blade, thereby providing a moderately decelerating flow extending to the trailing edge of the blade without involving the occurrence of a shock wave.

Figure 5:
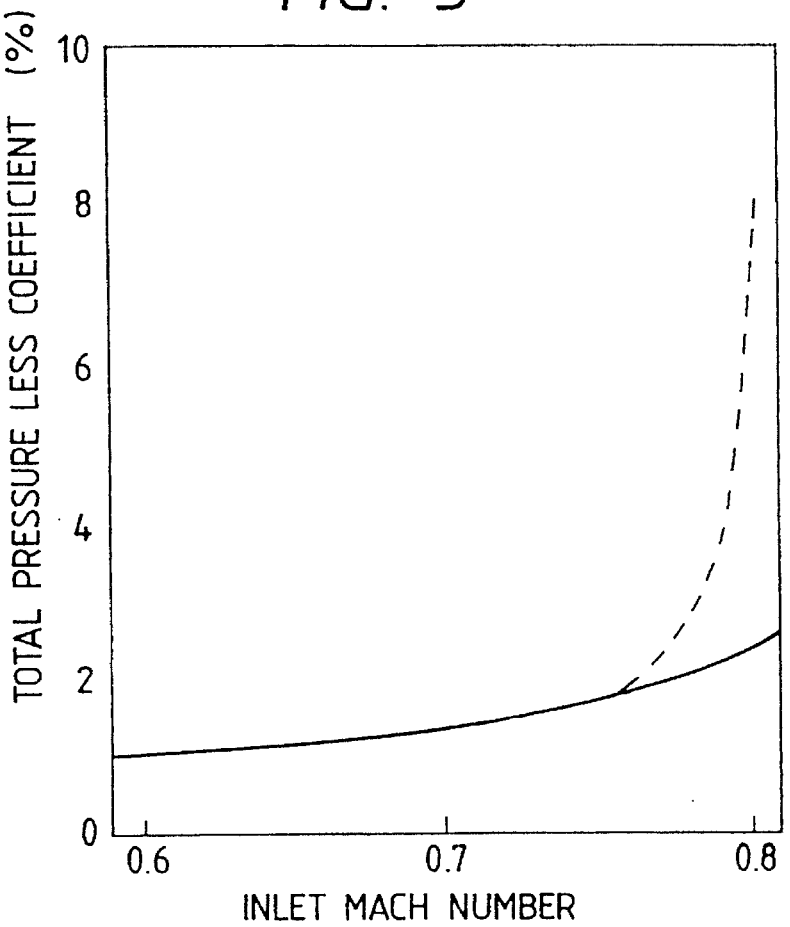
FIG. 5 is a diagram illustrative of total pressure loss coefficient.

FIG. 5 shows the result of measurements of the total pressure loss coefficient obtained in the cascade tests on the blade according to the invention (wolid line) and the blade of the prior art (dotted line) conducted in order to evaluate the blade row performance therebetween, which are shown in comparison with respect to the inlet Mach number versus the total pressure loss coefficient.

It is confirmed with the blade of the invention that in a higher subsonic region where the inlet Mach number is 0.8 or more, the occurrence of the shock wave having been avoided, a substantial decrease in pressure loss has been attained in comparison with large pressure loss associated with the prior art blade. It can be clearly seen that the blade according to the invention also has an excellent blade row performance in the subsonic region, and a wider operating region as well.

Although the present invention has been described heretofore by way of example as applied to the stator blade in respect of its acts and effects, it is not limited thereto, but should be construed that the same acts and effects can be attained when applied to the rotor blade in operation at a higher subsonic velocity.

Figure 6:
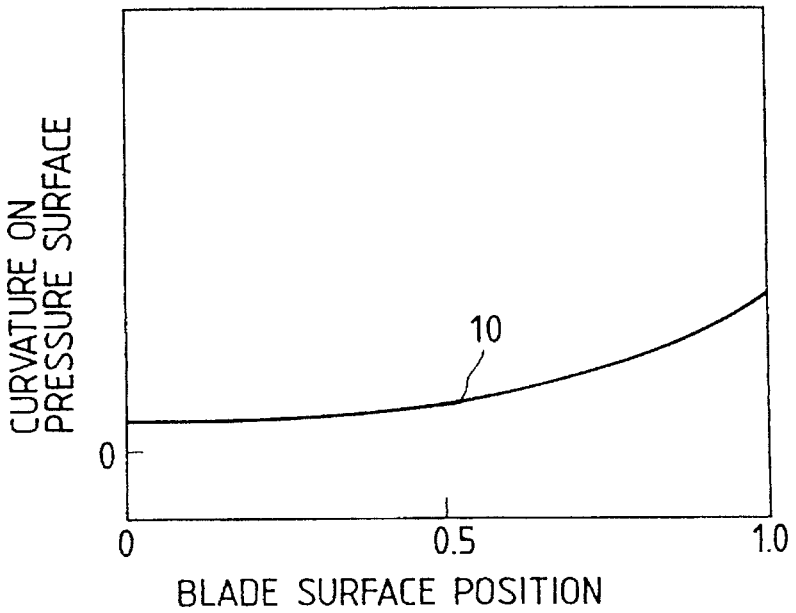
FIG. 6 is a curvature distribution on the pressure surface.

With reference to FIG. 6, there is shown a curvature distribution curve 10 obtained on the pressure surface. When the curve 10 is adapted substantially to having a monotonic increase from the leading edge, the effect of the invention can be exhibited likewise.

A second embodiment of the invention will be set forth in the following.

Figure 7:
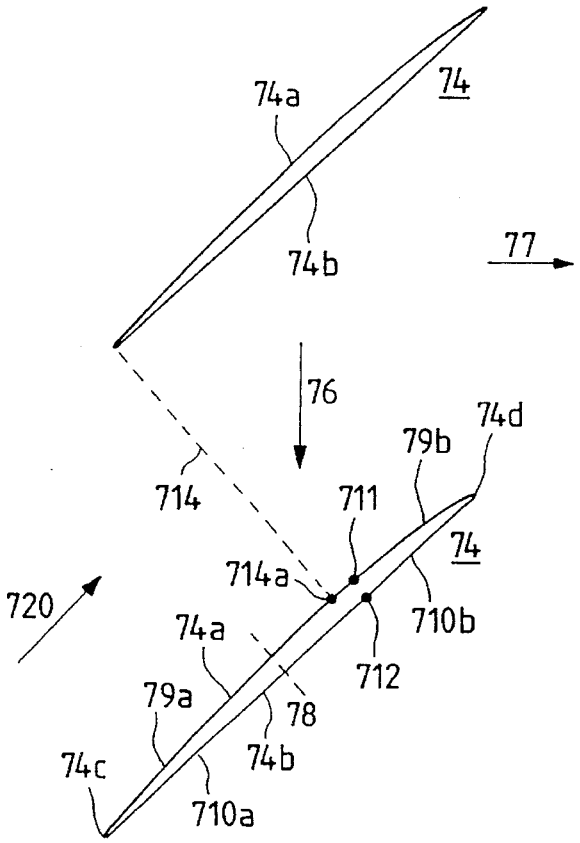
FIG. 7 is a cylindrical cross-sectional view of part of a rotor row.

With reference to FIG. 7, the second embodiment of the invention will be described in detail. FIG. 7 is a cross-sectional view of a row of rotor blades 74 showing cylindrical cross-sections thereof. A cylindrical cross-section of each rotor blade 74 has the same profile as that of a following rotor blade juxtaposed therewith in a rotational direction 76 as shown in FIG. 7, and comprises a suction surface 74*a*, a pressure surface 74*b*, a leading edge portion 74*c* and a trailing edge portion 74*d*. An arrow 77 indicates an axial direction of a rotating axis, and an arrow 720 indicates a direction of a relative flow at the inlet of the blade row. The aforementioned suction surface 74*a* and the pressure surface 74*b* comprise two circular arcs 79*a*, 79*b* and 710*a*, 710*b*, respectively which are connected smoothly along their joint line of connection points 711, 712 which are located in regions toward the trailing edge from the center 78 of a chord length of the blade and from a suction surface position 714*a* of a throat 714 as well.

Further, the circular arc which is located in a region toward the leading edge is adapted to have a larger radius of curvature than that of the circular arc which is located toward the trailing edge. As for the stator blade 3, since it has the same construction as that of the rotor blade 74 excepting that it does rotate further description thereof is omitted.

Figure 8:
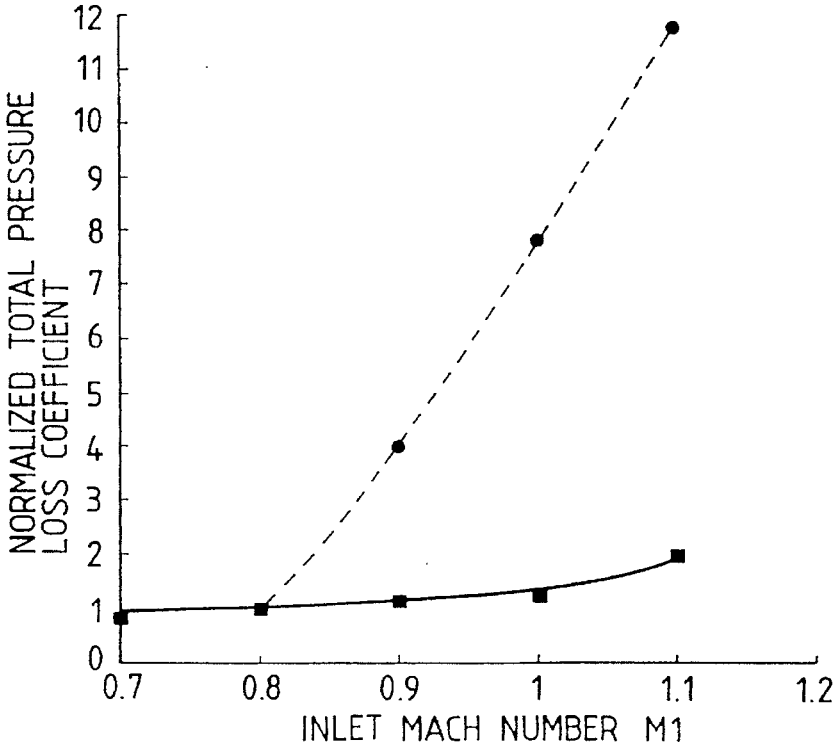
FIG. 8 compares the total pressure loss coefficient with respect to the inlet Mach number.

FIG. 8 shows experimental results of the total pressure loss coefficient for the rotor blade 74 having a profile as shown in FIG. 7, which were obtained as one of the indices for evaluating the blade row performance thereof.

The axis of abscissas represents the inlet Mach number (M1), and the axis of ordinates represents respective values of total pressure loss coefficient, which is normalized by one at M1=0.8. With an increase in the inlet Mach number M1, the corresponding total pressure loss increases (as shown by the dotted line with solid circles) such that with respect to the total pressure loss coefficient at M1=0.8, the total pressure loss increases 1.3 times at M1=1.0, and two times at M1=1.1. On the other hand, in the case of the double circular arc blade (solid line with solid squares) in which each of the suction surface 74*a* and the pressure surface 74*b* is composed of a singular circular arc, the total pressure loss increases as much as 7.8 times at M1=1.0, and 11.8 times at M1=1.1.

Figure 9:
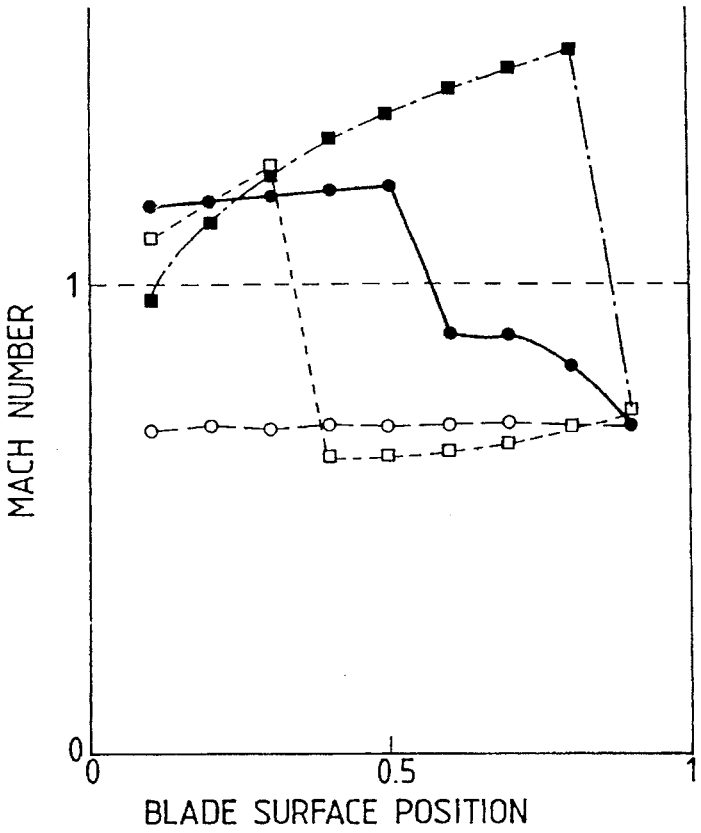
FIG. 9 is a diagram showing the distribution of Mach number on the blade surface when M1=1.05.

Causes of the above will be described in the following. The results of measurements of the Mach number distributions on the suction surface and the pressure surface are shown in FIG. 9 for the case when the inlet Mach number is M1=1.05. The axis of abscissas indicates respective positions on the blade surface in dimensionless units with the leading edge set at 0 and the trailing edge at 1.0, while the axis of ordinates indicates respective Mach numbers corresponding to respective positions on the blade surface. With respect to symbols indicative of respective experimental values, the blade according to the invention is indicated by solid circles for its suction surface and open circles for the pressure surface, while the double circular arc blade is indicated by solid squares for the suction surface and open squares for the pressure surface, respectively. In the case of the blade according to the invention, a distribution on the pressure surface is substantially flat, and an incremental rate of velocity on the suction surface is small in a region toward the leading edge thereof, with a relatively smaller degree of deceleration also along its rapid decelerating region. On the other hand, in the case of the double circular arc blade, there exist steep decelerating portions both on the suction surface and the pressure surface, involving greater rates of increment in velocity toward the leading edge and greater Mach number as well.

Figure 10:
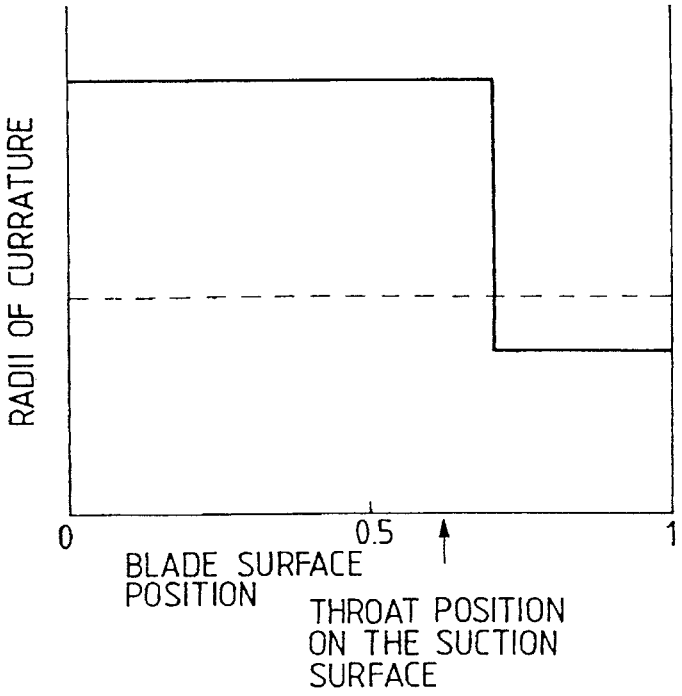
FIG. 10 is a diagram showing the distribution of radii of curvature on the suction surface.

These differences between the above two are illustrated in FIG. 10 in respect of distributions of radii of curvature on the suction surface. The axis of abscissas represents respective positions on the blade surface in dimensionless units with the leading edge set to be 0 and the trailing edge to be 1. The axis of ordinates represents respective radii of curvature corresponding to respective positions on the blade surface. The radius of curvature of the double circular arc blade is given in dot lines as a reference, and the radius of curvature of the blade according to the invention is given in a solid line in which a portion where the radius of curvature thereof changes abruptly corresponds to a junction point where two circular arcs connect together. Since the radius of curvature of the circular arc in the region toward the leading edge of the blade of the invention has a substantially larger value than that of the radius of curvature of the double circular arc blade, it has a substantially smaller rate of increment in velocity in the region toward the leading edge.

In addition, since the joint line of connecting points between the two circular arcs lies in a region toward the trailing edge from the position 714*a* on the suction surface corresponding to the throat 714, the rate of increment in velocity will not become greater in a region which is toward the leading edge than from the throat 714. From these causes described above, it can be understood that the blade of the invention has a smaller value of maximum Mach number, and a smaller degree of decelerating velocity.

Figure 11:
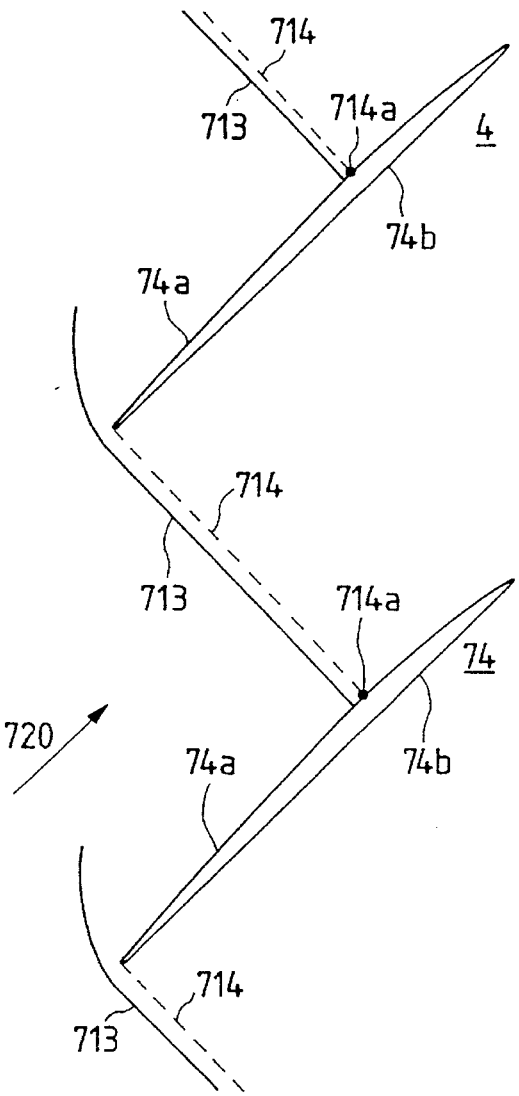
FIG. 11 is a diagram showing visualization experiments for the blade cascade according to the invention.
Figure 12:
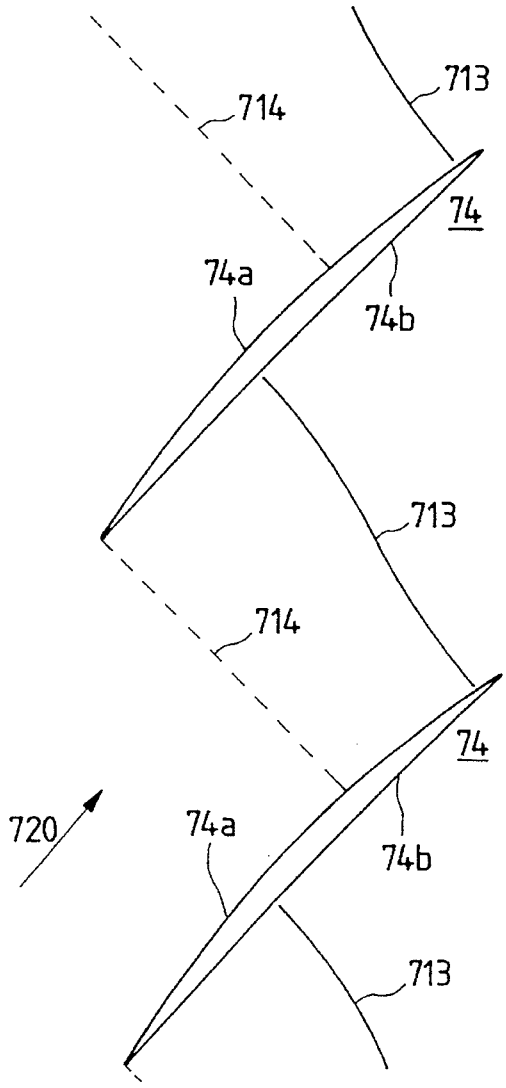
FIG. 12 is a diagram visualizing the double circular arc cascade.

Further, with reference to FIGS. 11 and 12, respective positions 713 indicative of a shock wave plane are compared therebetween which are obtained as a result of visualization experiments where an abrupt deceleration from a supersonic to a subsonic velocity takes place. As shown in FIG. 11, the shock wave plane 713 arising in the blade row of the invention is located at a point toward the leading edge of the blade from the position of the throat 714, and its attachment is limited only to the suction surface 74*a*. This corresponds to the observation revealed in FIG. 9 that the steep decelerating portion exists only on the suction surface for the blade of the invention. On the other hand, in the case of the double circular arc blade as shown in FIG. 12, the shock wave frontal plane 713 exists in a region toward the trailing edge of the blade from the position of throat 714, and moreover, it attaches both to the suction surface 74*a* and the pressure surface 74*b*.

As described hereinabove, according to the present invention, since the rate of increment in velocity of the flow on the blade surface along the leading edge portion becomes smaller in comparison with that of the prior art, the maximum Mach number can be decreased significantly. Further, since the shock wave plane 713 can be shifted toward the leading edge portion from the throat 714, pressure loss due to the shock wave can be minimized, and a significant improvement of the efficiency of the axial compressor can be accomplished.

Figure 13:
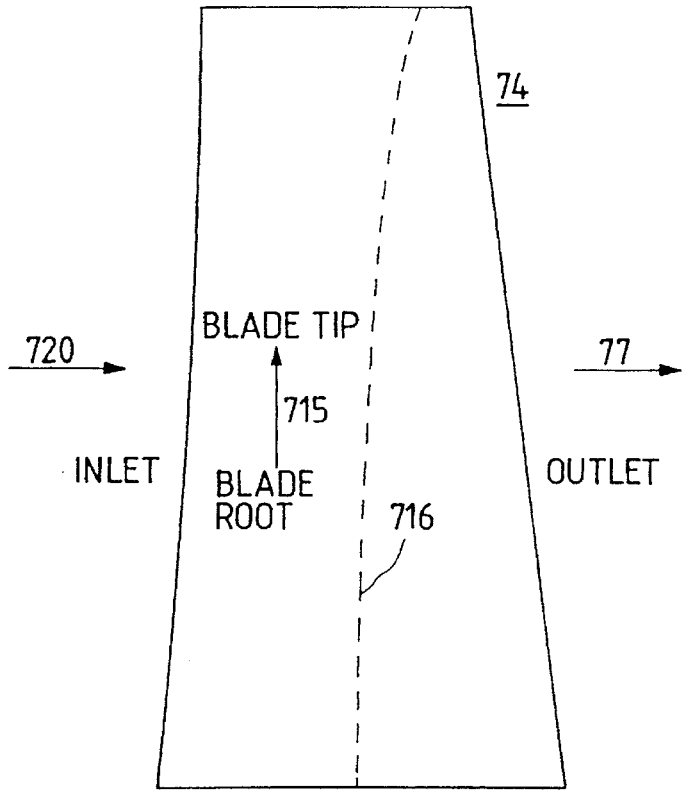
FIG. 13 is a projection diagram of the meridian planes on the suction surface according to the invention.

In the foregoing embodiment of the invention, it may be arranged for the joint line of connecting points 711 or 712 connecting between the two circular arcs to be shifted gradually toward the leading edge along a blade length direction from the blade tip to the blade root thereof. FIG. 13 shows such an example of a rotor blade of the invention, in which an arrow 715 indicates the blade height direction with the upper direction showing the tip end and the lower direction showing the blade root thereof. Further, the left-side thereof indicates the blade row inlet side, namely, the leading edge side. Broken line 716 represents joint points 711 between the circular arcs on the suction surface as connected in a line in the blade height direction, wherein at the tip end portion where the inlet Mach number is greater, the joint points 711 are arranged in a portion toward the trailing edge, and when approaching toward the blade root side where the Mach number decreases, the joint points 711 are arranged to gradually shift toward the leading edge side. Joint points 712 on the pressure surface are also arranged in the a like manner, thus, further description thereof will be omitted.

Figure 14:
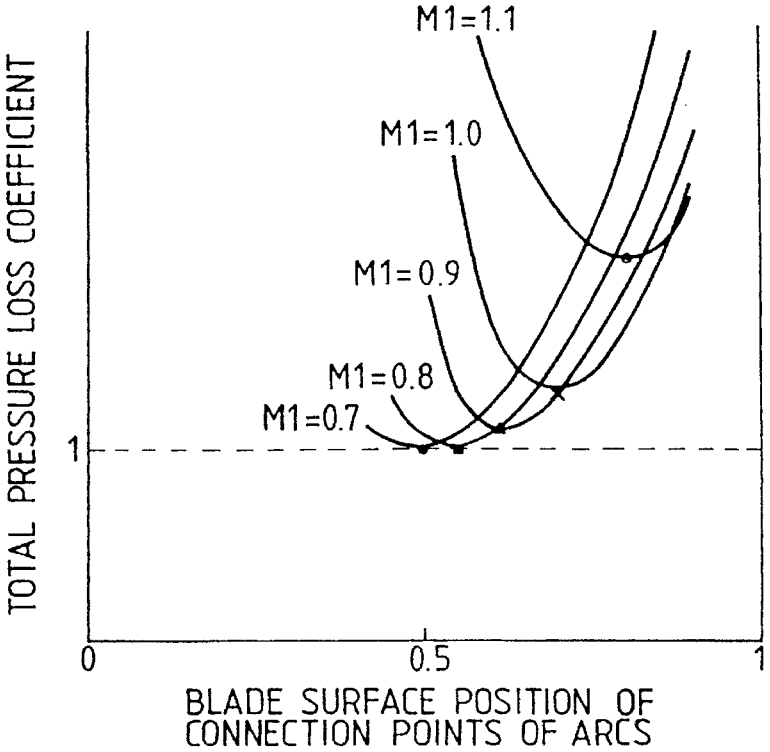
FIG. 14 shows the influence of joint points between the circular arcs on the total pressure losses.

The reason why the joint lines of connection points between the circular arcs are changed will be described in more detail with reference to FIG. 14. The curves in FIG. 14 compare the total pressure loss coefficients obtained for the results of the flow computation of a blade-to-blade when the joint line of points 711 between the circular arcs is changed with a varying inlet Mach number as parameters. The axis of abscissas of the drawing represents respective joint positions between the arcs in dimensionless units with the leading edge set as 0 and the trailing edge set as 1. On the axis of ordinates, a minimum value is set to be 1 for a total pressure loss coefficient which was obtained by variously changing the joint points of arcs for a case when the inlet Mach number M1=0.8. Respective solid curves in the drawing indicate each value corresponding to the joint point of the arcs when it is changed for specific inlet Mach numbers M1. Each point of a minimum value on each solid curve is indicated by a symbol: a solid circle for M1=0.7, a solid square for M1=0.8, a solid triangle for M1=0.9, × for M1=1.0 and an open circle for M1=1.1. Since a junction point where the total pressure loss coefficient becomes minimum shifts from the trailing edge toward the leading edge with a decreasing blade row inlet Mach number M1, the total pressure loss through the blade rows can be minimized by adopting an appropriate joint line of connecting points corresponding to the respective inlet Mach number.

Figure 15:
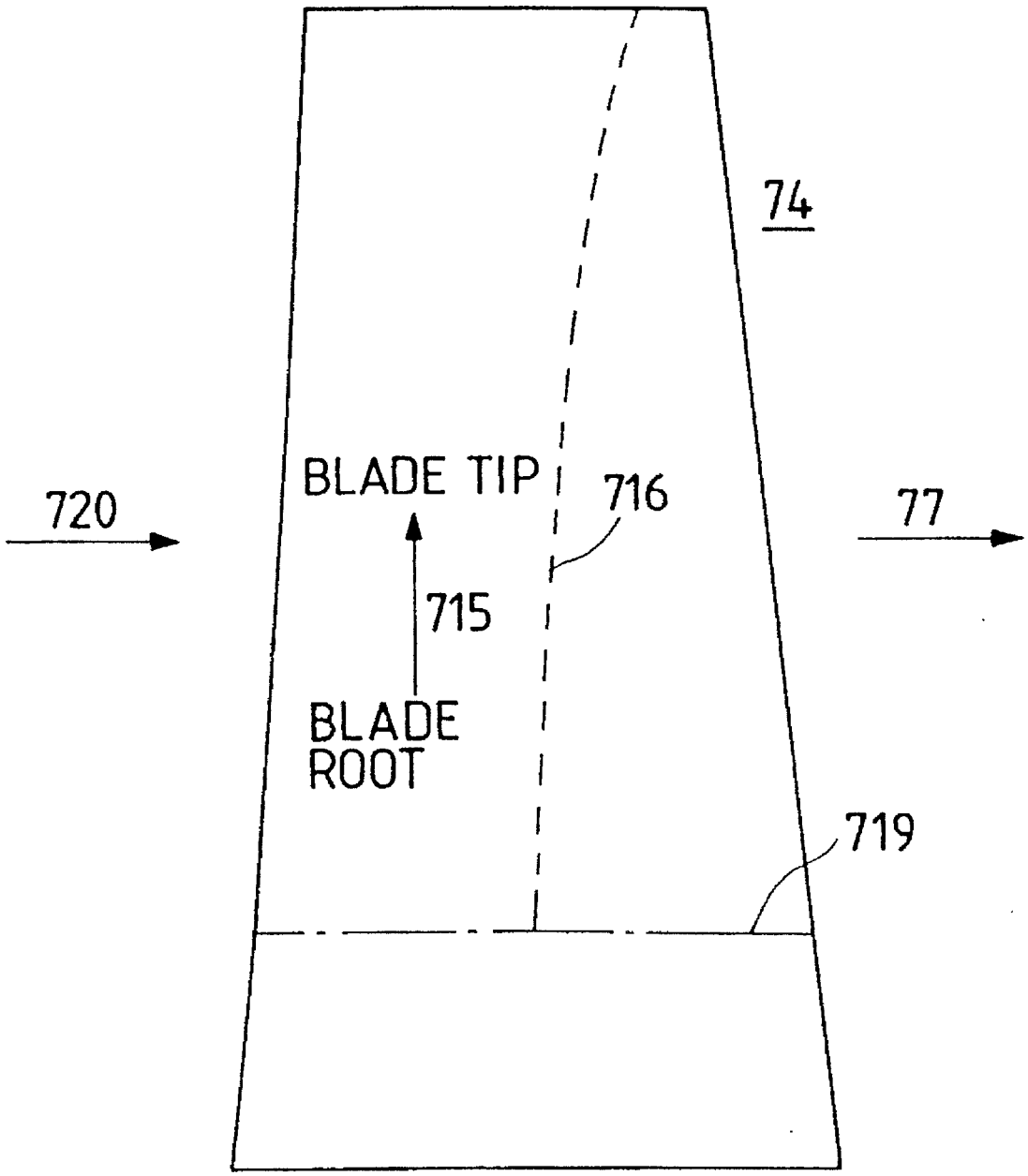
FIG. 15 is a projection diagram illustrative of meridian planes in which the blade profile of the invention and the double circular arc blade are combined.

In the foregoing embodiment of the invention, a portion of the blade profile of the stator blade or rotor blade toward the blade root where the inlet Mach number is in a lower range may adopt a double circular arc profile or an NACA-65 profile. FIG. 15 shows a rotor blade of another embodiment according to the invention as seen from the same direction as in Fig. 13. In the blade tip region where the inlet Mach number is greater, a blade profile according to the invention is adopted, and in the blade root region where the Mach number becomes smaller, a conventional double circular arc profile is adopted. Chain line 719 in the drawing denotes a junction between the blade profile of the invention and the double circular arc blade. On the blade of the invention in the vicinity of the junction with the double circular arc profile, joint points between the two circular arcs of the blade of the invention lie approximately in the center portion of a chord length of the blade where since their radii of curvature are adapted to be substantially the same, their junction is substantially smooth. An advantage to be implemented in combination by this blade arrangement is that design and manufacturing costs can be minimized through adoption of the conventional blade design in the portion of the blade profile where the inlet Mach number is lower.

As has been described hereinabove, since the radii of curvature of the stator blade row or the rotor blade row according to the invention are arranged to have a local minimum once in the portion toward the leading edge, and then a local maximum downstream thereof, the excessive increment in velocity in a region from the leading edge to the point of the maximum velocity on the suction surface can be suppressed even when the inlet flow is in a higher subsonic range. Therefore, so as to avoid the occurrence of a shock wave, pressure loss through the blade row can be minimized and the efficiency of the axial flow compressor can be improved significantly.

Many other variations and modifications of the invention will be apparent to those skilled in the art without departing from the spirit and scope of the invention, and all such variations and modifications are intended to be included within the scope of the invention as defined in the appended claims.

What is claimed is:

1. An axial flow compressor comprising a plurality of stator blade rows mounted on an inner surface of a casing which constitutes an annular passage and a plurality of rotor blade rows mounted on a rotor, wherein a distribution of curvature of a suction surface has a minimum value and a maximum value for each of said plurality of stator blades, said minimum value and maximum value of each stator blade occurring in a region from a leading edge to a trailing edge thereof, said stator blade suction surface curvature having a smooth distribution, and said maximum value of each stator blade occurring between said minimum value and said trailing edge thereof.

2. An axial flow compressor according to claim 1, wherein a distribution of curvature of a suction surface has a minimum value and a maximum value for each of said plurality of rotor blades, said minimum value and maximum value of said rotor blades occurring in a region from a leading edge to a trailing edge thereof, said rotor blade suction surface curvature having a smooth distribution, and said maximum value of each rotor blade occurring between said minimum value and said trailing edge thereof.

3. An axial flow compressor comprising a plurality of stator blade rows mounted on an inner surface of a casing which constitutes an annular passage and a plurality of rotor blade rows mounted on a rotor, wherein a distribution of curvature on a suction surface has a minimum value and a maximum value for each of said plurality of stator blades, a Mach number on each stator blade suction surface increasing thereacross from a value at a leading edge thereof to exceed Mach number 1 to a maximum Mach number therefor, and then decreasing approaching the trailing edge thereof, said minimum value occurring between a position where the Mach number on the stator blade suction surface becomes 1 and a position where said Mach number is at said maximum.

4. An axial flow compressor according to claim 3, wherein a distribution of curvature on a suction surface has a minimum value and a maximum value for each of said plurality of rotor blades, a Mach number on each rotor blade suction surface increasing thereacross from a value at a leading edge thereof to exceed Mach number 1 to a maximum Mach number therefor, and then decreasing approaching the trailing edge thereof, said minimum value occurring between a position where the Mach number on the rotor blade suction surface becomes 1 and a position where said Mach number is at said maximum.

5. An axial flow compressor comprising a plurality of stator blade rows mounted on an inner surface of a casing which constitutes an annular passage and a plurality of rotor blade rows mounted on a rotor, wherein a distribution of curvature on a suction surface has a maximum value for each of said plurality of stator blades, a Mach number on each stator blade suction surface increasing thereacross from a value at a leading edge thereof to exceed Mach number 1 to a maximum Mach number therefor, and then decreasing when approaching the trailing edge thereof, the maximum value occurring at a position where said Mach number is at said maximum.

6. An axial flow compressor comprising a plurality of stator blade rows mounted on an inner surface of a casing which constitutes an annular passage and a plurality of rotor blade rows mounted on a rotor, wherein a suction surface or a pressure surface of each blade of at least one row of the blade row of said plurality of stator blade rows or said plurality of rotor blade rows comprises at least two circular arcs, the joining ends of which are respectively arranged to join in a region toward a trailing edge of the blade from the center of a chord length of the blade and from a throat position on the suction surface, and wherein a first circular arc of said at least two circular arcs located toward a leading edge of the blade has a larger radius of curvature than a radius of curvature of a second one of said at least two arcs.

7. An axial flow compressor according to claim 6, wherein said joining ends of the at least two circular arcs to be joined comprise a joint line which is arranged gradually to shift form the trailing edge to the leading edge from a blade tip cross-section to a blade root cross-section thereof.

8. An axial compressor according to claim 6, wherein a blade profile in a region of said stator blade or rotor blade in the vicinity of its blade root where the inlet Mach number is smaller comprises in combination a double circular arc blade profile.

9. An axial flow compressor comprising a plurality of stator blade rows mounted on an inner surface of a casing which constitutes an annular passage and a plurality of rotor blade rows mounted on a rotor, wherein a suction surface of each blade of at least one row of said plurality of stator blade rows or said plurality of rotor blade rows comprises at least two circular arcs each having the same curvature direction, said at least two circular arcs joining in a leading edge region upstream from the center of a blade chord length and from a throat position, and wherein the curvatures of said arcs have an extreme value at said joining point.

10. An axial flow compressor according to claim 9, wherein a pressure surface of each blade of at least one row of said plurality of stator blade rows or said plurality of rotor blade rows comprises at least two circular arcs each having the same curvature direction, said at least two circular arcs joining in a leading edge region upstream from the center of a blade chord length and from a throat position, and wherein the curvatures of said arcs have an extreme value at said joining point.

11. An axial flow compressor comprising a plurality of stator blade rows mounted on an inner surface of a casing which constitutes an annular passage and a plurality of rotor blade rows mounted on a rotor, wherein a distribution of curvature of a suction surface has a minimum value and a maximum value for each of said plurality of rotor blades, said minimum value and maximum value of each rotor blade occurring in a region from a leading edge to a trailing edge thereof, said rotor blade suction surface curvature having a smooth distribution, and said maximum value of each rotor blade occurring between said minimum value and said trailing edge thereof.

12. An axial flow compressor comprising a plurality of stator blade rows mounted on an inner surface of a casing which constitutes an annular passage and a plurality of rotor blade rows mounted on a rotor, wherein a distribution of curvature on a suction surface has a minimum value and a maximum value for each of said plurality of rotor blades, a Mach number on each rotor blade suction surface increasing thereacross from a value at a leading edge thereof to exceed Mach number 1 to a maximum Mach number therefor, and then decreasing approaching the trailing edge thereof, said minimum value occurring between a position where the Mach number on the rotor blade suction surface becomes 1 and a position where said Mach number is at said maximum.

* * * * *